US005857293A

United States Patent [19]

Redjvani

[11] Patent Number: 5,857,293

[45] Date of Patent: Jan. 12, 1999

[54] FLEXIBLE FORMWORK ASSEMBLY

[75] Inventor: Assadollah Redjvani, North Epping, Australia

[73] Assignee: Flexible Formwork Pty. Ltd., New South Wales, Australia

[21] Appl. No.: 637,695

[22] PCT Filed: Nov. 4, 1994

[86] PCT No.: PCT/AU94/00676

§ 371 Date: Apr. 30, 1996

§ 102(e) Date: Apr. 30, 1996

[87] PCT Pub. No.: WO95/12726

PCT Pub. Date: May 11, 1995

[30] Foreign Application Priority Data

| | | | |
|---|---|---|---|
| Nov. 2, 1993 | [AU] | Australia | PM2144 |
| Jan. 10, 1994 | [AU] | Australia | PM3277 |
| May 10, 1994 | [AU] | Australia | PM5512 |

[51] Int. Cl.[6] ..... E04G 11/00

[52] U.S. Cl. ..... 52/63; 52/222; 52/426; 52/632; 52/646; 52/742.14

[58] Field of Search ..... 52/310, 426, 632, 52/646, 742.14, 63, 222; 249/10, 19, 33, 45

[56] References Cited

U.S. PATENT DOCUMENTS 3,396,545 8/1968 Lamberton .
3,555,751 1/1971 Thorgusen .
3,726,950 4/1973 Turzillo .

FOREIGN PATENT DOCUMENTS 2637632 4/1990 France .
2091312 7/1982 United Kingdom .

*Primary Examiner*—Christopher Todd Kent
*Attorney, Agent, or Firm*—Ladas & Parry

[57] ABSTRACT

A method of casting concrete structures using a "flexible formwork assembly". The assembly has flexible sheets suspended from a fixed location, preferably from a supporting frame assembled on top of the reinforcing members, with rigid stress distribution members located to the outer surface of flexible sheets in predetermined spacings so as to carry load directly and to redistribute stress in the sheet so as to aid the sheet to withstand the concrete pressure. The majority of stress distribution members are arranged in pairs which are directly connected to each other by ties in wall type structures. Reinforcing members are used as a main frame or skeleton to hold and suspend the formwork assembly. Spacers are used to aid in maintaining the sheets in a desired location which ensure adequate concrete cover to the reinforcing prior to pouring of the concrete. Stress distribution members provide external shape, configuration and pattern to the concrete surface by their shape and arrangement. In-situ concreting of walls of most shapes and configurations under water is made viable by this system.

26 Claims, 12 Drawing Sheets

FIG. 19
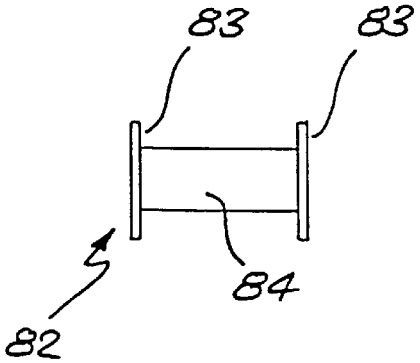
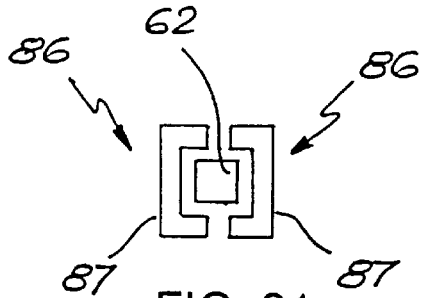
FIG. 21
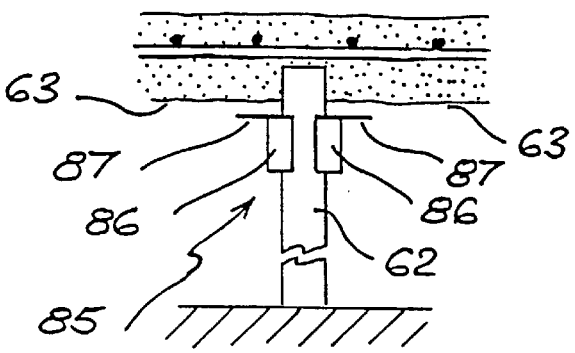
FIG. 20
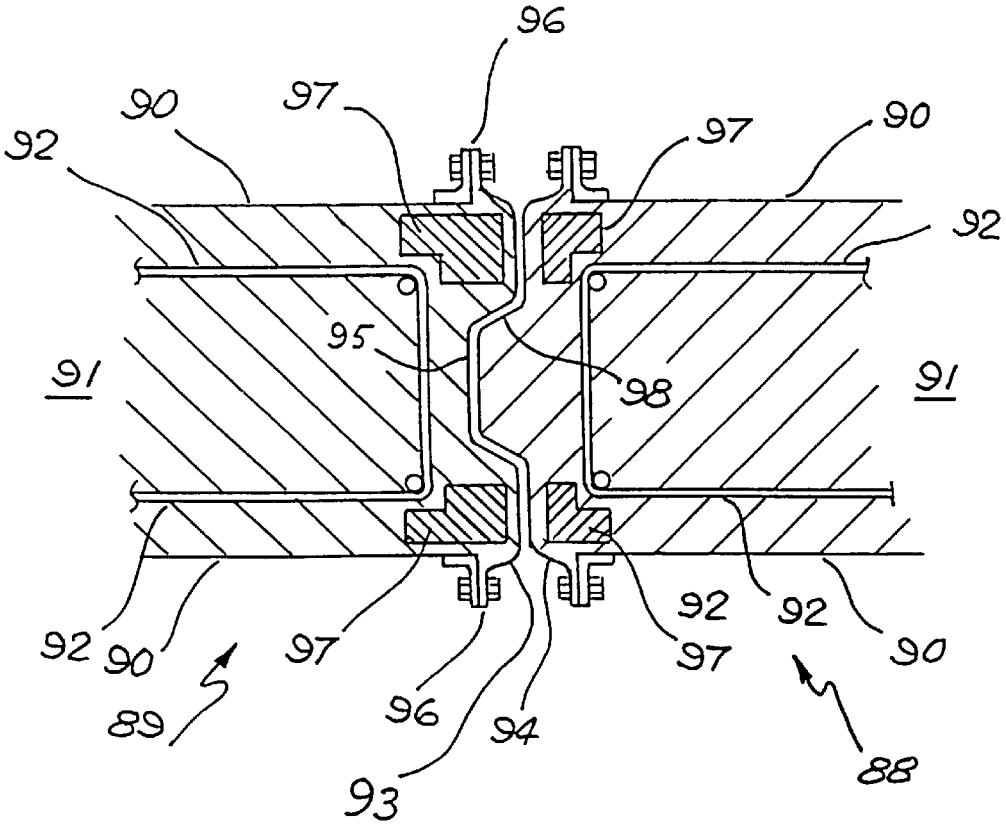
FIG. 22

FLEXIBLE FORMWORK ASSEMBLY

TECHNICAL FIELD

The present invention relates to formwork and more particularly but not exclusively to the use of flexible sheet in formwork to form concrete structures for marine and land environments.

BACKGROUND OF THE INVENTION

Traditionally formwork has consisted of rigid material such as sheets. Typically, the sheet would be plywood and would be held in position by timber brace members.

The above discussed traditional formwork is time consuming and expensive to erect.

Further to the above, in-situ casting of concrete structures in wet areas is difficult. This is particularly a problem with forming marine structures due to difficulties which exist in setting up the formwork under water.

OBJECT OF THE INVENTION

It is the object of the present invention to overcome or substantially ameliorate the above disadvantages.

SUMMARY OF THE INVENTION

There is disclosed herein a formwork comprising:

a water impermeable flexible sheet to define at least one side of a space to receive unset concrete;

stress distribution members fixed to a major surface of the sheet at spaced locations, which major surface does not confront said space, said distribution members being adapted to distribute within the sheet stresses, arising from the concrete within the space pressing on the sheet, to thereby aid the sheet to withstand pressure applied to the sheet; and a plurality of ties, each tie being fixed to and extending from an associated one of the members, the ties extending through the sheet and being fixed so as to support the associated members in a desired position to thereby support the sheet in a desired configuration until the concrete sets.

Preferably, in the above described formwork, the sheet would substantially enclose the space, so that stress distribution members are located on opposite sides of the space with the ties extending therebetween.

Preferably located in the space would be concrete reinforcing members.

Preferably the reinforcing members would support the sheet. Still further, it is preferred that the sheet be supported on the reinforcing members by a height adjustable frame.

There is further disclosed herein a method of erecting formwork, said method comprising the steps of:

providing a substantially water impermeable flexible sheet;

fixing to a major surface of the sheet, a plurality of stress distribution members;

providing a plurality of ties;

suspending the sheet from a fixed point;

securing each tie to an associated stress distribution member and fixing the ties so that the stress distribution members are held in a desired position to thereby hold the sheets in a desired configuration defining at least one side of a space, with the tie members extending from their associated stress distribution members and through the sheet and into said space.

Preferably, in the above described method, the sheet would be arranged so as to substantially enclose the space so that the ties extended through the space so as to extend between two associated stress distribution members located on opposite sides of the space.

Still further, preferably reinforcing members are located in the space prior to pouring of the concrete, and the sheet is supported on the reinforcing.

Still further, preferably spacers are located between the reinforcing members and the sheet securing spacers to the reinforcing cage.

BRIEF DESCRIPTION OF THE DRAWINGS

Preferred forms of the present invention will now be described by way of example with reference to the accompanying drawings wherein:

FIG. 19 is a schematic side elevation of a fitting to be employed in the formwork of FIG. 1, which fitting would provide for a duct to extend through the concrete structure formed;

FIG. 20 is a schematic sectioned side elevation of flexible formwork employing a collar fitting, used in conjunction with a preformed column;

FIG. 21 is a schematic top plan view of the column and collar fitting of FIG. 20;

FIG. 22 is a schematic sectioned plan view of the interconnection between two wall sections employing the formwork of FIG. 1;

DETAILED DESCRIPTION OF THE PREFERRED EMBODIMENTS

Figure 1:
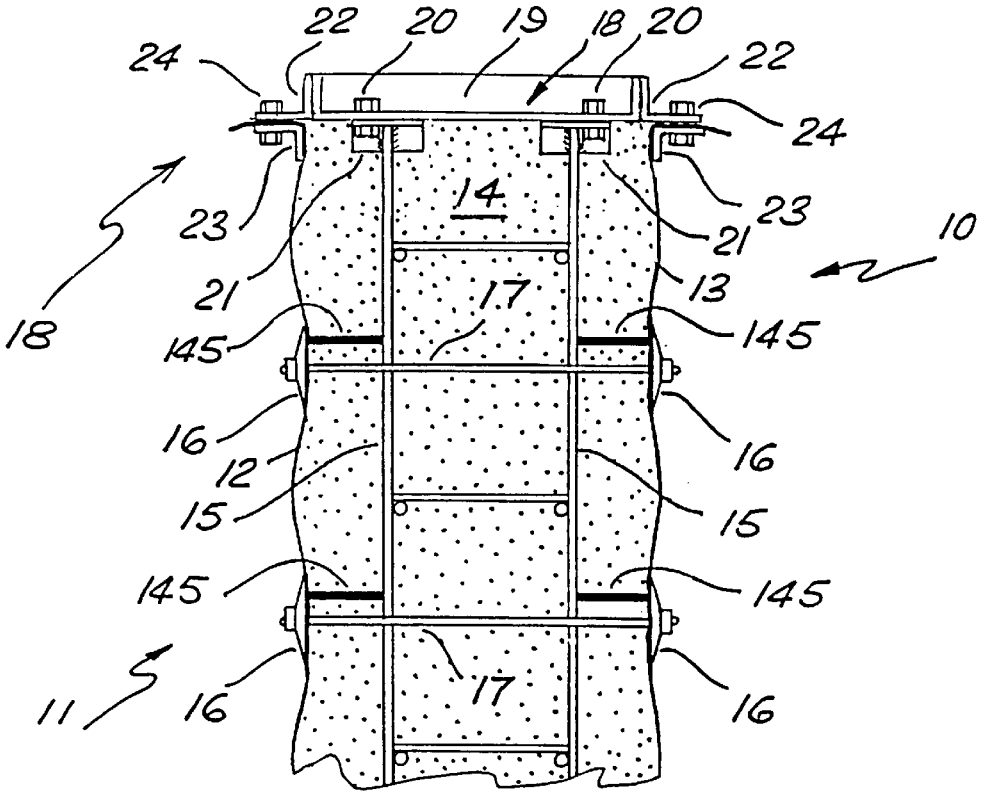
FIG. 1 is a schematic sectioned side elevation of a formwork enclosing a space occupied by concrete.

In FIGS. 1 to 8 of the accompanying drawings there is schematically depicted a concrete structure 10 which may be a wall, column, or other structure. The concrete structure 10 is moulded within a formwork assembly 11. The formwork assembly of this embodiment includes a pair of flexible sheets 12 and 13 which enclose a space occupied by the concrete 14 forming the structure 10. The structure 10 further includes a reinforcing cage 15.

Figure 2:
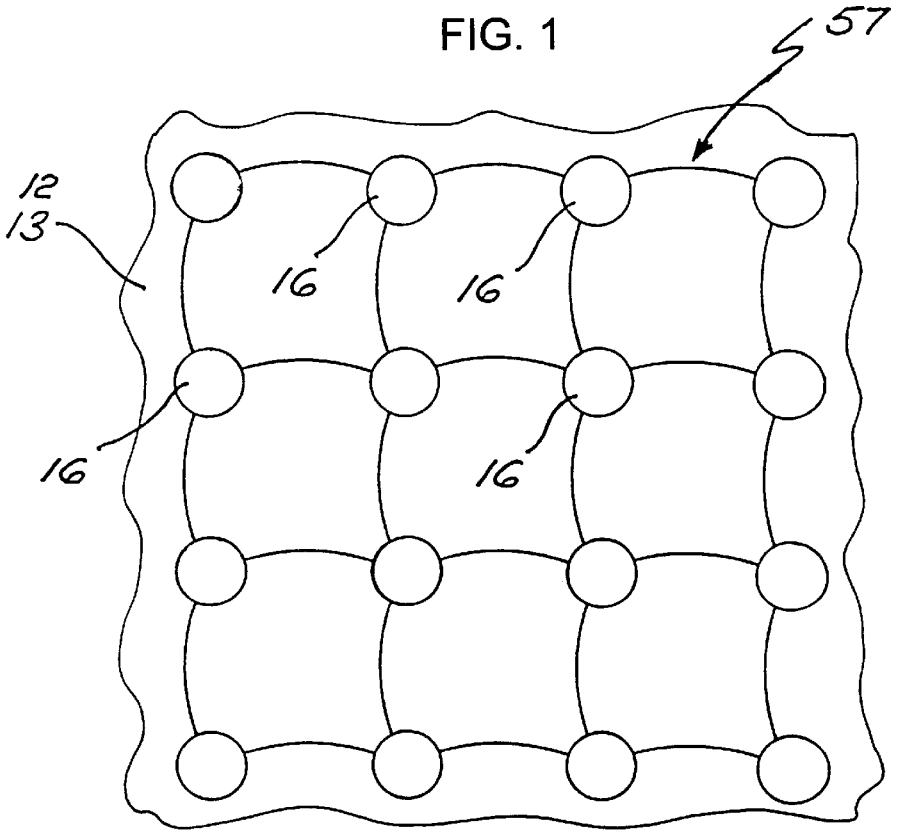
FIG. 2 is a schematic perspective view of a portion of a wall formed by the formwork of FIG. 1.
Figure 3:
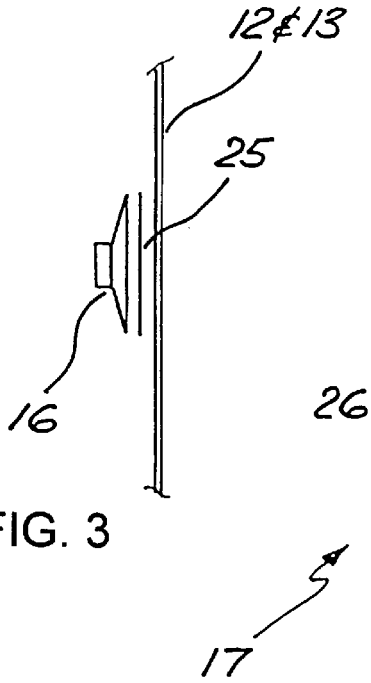
FIG. 3 is a schematic side elevation of a portion of the formwork of FIG. 1.
Figure 4:
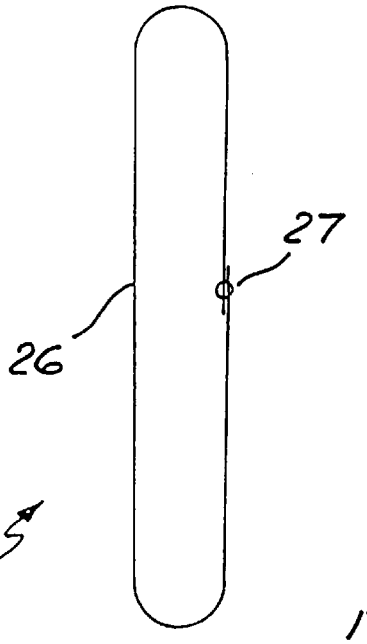
FIG. 4 is a schematic side elevation of a tie employable in the formwork of FIG. 1.

Each of the sheets 12 and 13 has a major surface confronting the concrete 14, and an outer major surface. Fixed to the outer major surfaces are stress distribution members 16 which in this embodiment have the configuration of a disc. The stress distribution members 16 are arranged in opposing pairs with the discs of each pair being located on opposite sides of the structure 10. Extending between each associated pair of members 16 is a tie 17. The tie 17 may be rigid or flexible as required. The spacers 145 are fixed to the cage 15 and the ties 17 are fixed to the discs 16 so as to aid in retaining the discs 16 at predetermined locations to thereby aid in maintaining a desired configuration for the sheets 12 and 13 and therefore ultimately the configuration of the structure 10. As best seen in FIG. 2, the discs 16 are distributed over the outer major surface of the sheets 12 and 13.

Provided at the upper end of the structure 10 is a support assembly 18. The support assembly 18 includes an upper frame 19 which is fixed to the reinforcing cage 15 by bolts 20 threadably engaging angles 21 attached to the upper end of the cage 15. The frame 19 includes angles 22 which cooperate with angles 23 to securely engage the upper edge portions of the sheets 12 and 13. More particularly, cooperating threaded fasteners 24 clamp together the angles 22 and angles 23 with portions of the sheets 12 and 13 located therebetween. Therefore, the sheets 12 and 13 and the stress distribution members 16 are suspended from the support assembly 18. The support assembly 18 is adjustable in height through bolts 20, to provide tension in the sheets 12 and 13 when required. The cage 15 therefore supports the sheets 12 and 13. The stress distribution members 16 may be attached to the sheets 12 and 13 after the sheets 12 and 13 are suspended from the support assembly 18.

If needed, a gasket may be located between the angles 22 and the angles 23 to aid in uniformly distributing the stress to the sheets 12 and 13.

The stress distribution members 16 may be bonded to the sheets 12 and 13 and would be sized in order to accommodate the stress they are to distribute and the desired deflection pattern. If so required, the sheets 12 and 13 may be tensioned in order to minimise the deflection thereof.

The external configuration of the structure 10 and double curvature pattern 57 produced, is determined by the tension in the sheets 12 and 13, length of ties 17 as well as the spacing and size of the stress distribution members 16.

Preferably, the sheets 12 and 13 would be PVC coated polyester fabric, or similar water impermeable or semi-impermeable fabric. If so required, the sheets 12 and 13 could be reinforced with wire mesh embedded in the sheets 12 and 13. Adjoining sections of sheets 12 and 13 can be overlapped and bonded by gluing, sewing, welding or using a zipper. The sheets 12 and 13 can each be assembled from several layers of the flexible sheets bonded or fixed to each other through ties.

It should be appreciated that apertures are pierced in the sheets 12 and 13 in order to permit the ties 17 to pass therethrough. The stress distribution members 16, as mentioned above, may be bonded to the sheets 12 and 13. This bonding could be by way of adhesive or they may be mechanically fixed to or if the members 16 are formed of plastics material, they may be welded to the sheets 12 and 13. Members 16 may be made of one or several pieces of the same or different materials. If so required, interposed between the members 16 and the sheets 12 and 13 are pads 25 which may be resilient if required or made from flexible sheet materials. The pads 25 may be bonded to the sheets 12 and 13, and would aid in distributing the stress thereto. The stress distribution members 16 may be fixed to the pads 25 if required. Such fixing could be by way of fasteners or clamps. After concreting members 16 may be detached and reused again.

Figure 5:
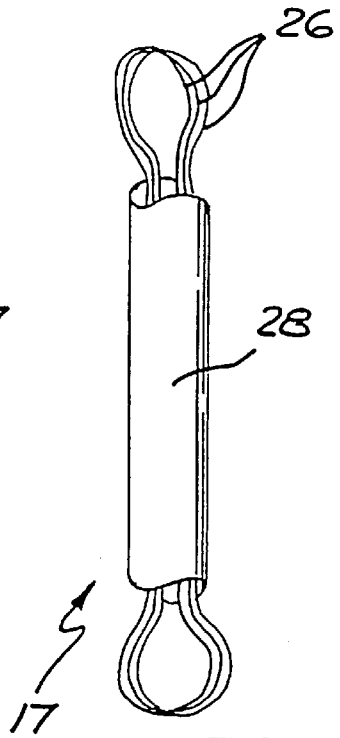
FIG. 5 is a schematic side elevation of a further tie which may be employed in the formwork of FIG. 1.

The ties 17, if made of flexible material, could be formed of one or more loops 26 of flexible material. The extremities would be secured together by means of sewing or a fastener 27. The loops 26 may pass through a sheath 28 as best seen in FIG. 5. The loops 26 would pass about pins engaging the exposed outer surface of the members 16.

Figure 8:
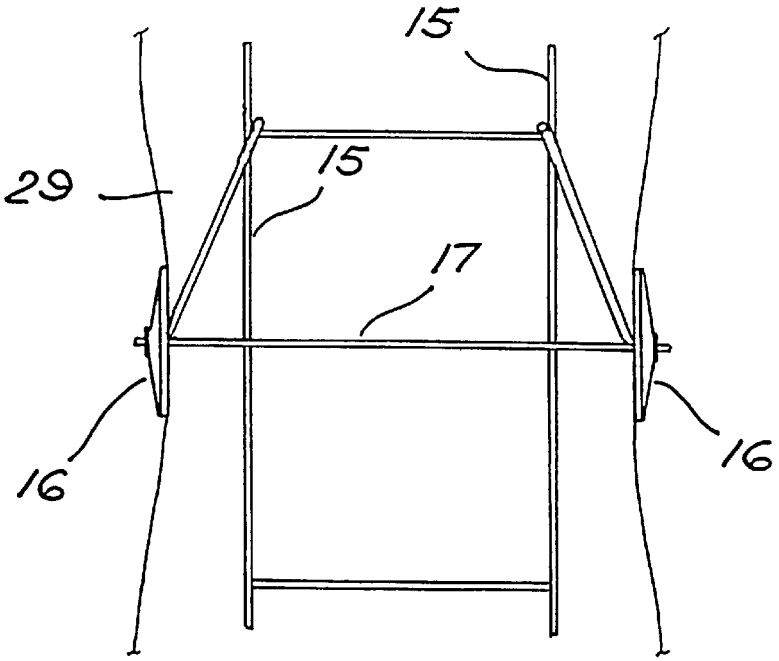
FIG. 8 is a schematic side elevation of a further formwork.

To further aid in retaining the members 16 at a desired location, ties 29 could extend between the reinforcing cage 15 to the members 16 as best seen in FIG. 8.

The ties 17 could be coated with form oil or located in plastic conduits, to aid their removal if required. Ties may be made of a variety of materials such as polyester cords. wires, plastic clamps or metal bars.

Figure 6:
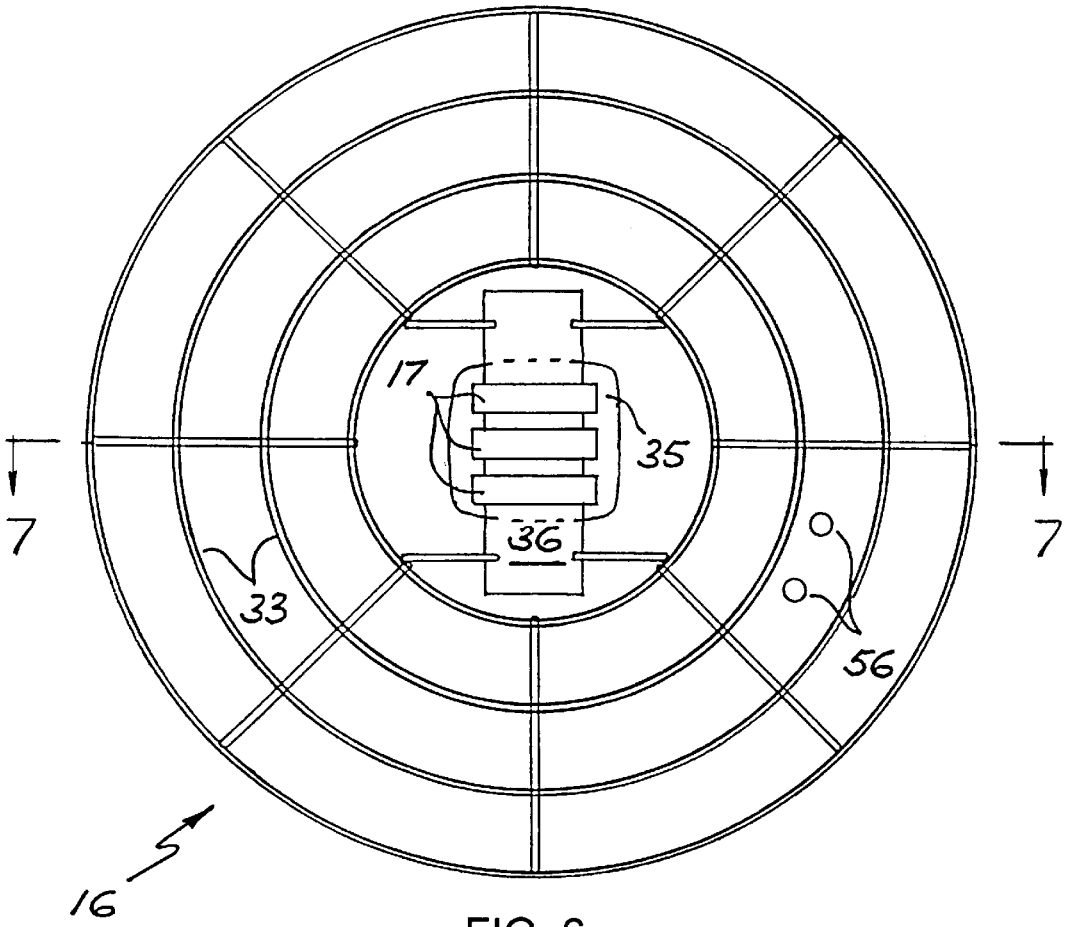
FIG. 6 is a schematic plan view of a stress distribution member employed in the formwork of FIG. 1.
Figure 7:
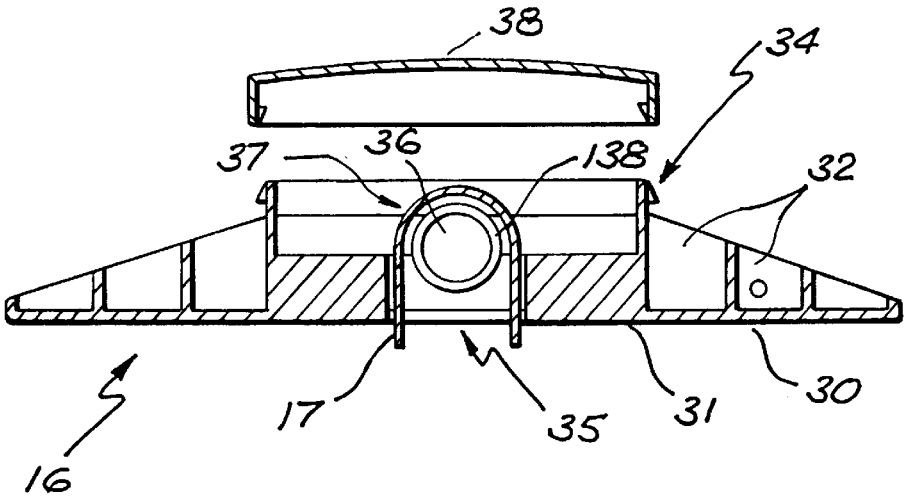
FIG. 7 is a schematic side elevation of the stress distribution member of FIG. 6, sectioned along the line A—A.

In FIGS. 6 and 7 there is schematically depicted one of the stress distribution members 16. In this embodiment, the stress distribution members 16 are of a disc configuration and are molded from hard plastics material. However other materials such as metal are contemplated. The member 16 has a generally planar surface 30 to which the sheets 12 and 13 are fixed. The surface 30 forms part of a base portion 31 which is generally planar in configuration and from which there extends reinforcing ribs 32. There may be also provided, if required, annular reinforcing ribs 33. In the centre there is a hub 34 containing an aperture 35 which extends through the base 31. This permits the ties 17 to pass through the member 16 and to engage a pin 36. The hub 34 provides a cradle 37 for the pin 36. As best seen in FIGS. 6 and 7, the ties 17 loop over the pin 36. Preferably, the pin 36 would be "snap" engaged within the cradle 37 but is removable in order to release the ties 17 and therefore permit removal of the member 16 once the concrete has set. Holes 138 may be provided in the hub 34 to allow removal of the pin 36.

A cap 38 snap engages over the hub 34. If so required, the cap 38 could be configured so as to cover and bond to the entire external surface of the member 16 apart from the surface 30 by means of adhesives or threads.

The member 16 is intended to abut the sheets 11 and 12 and to be bonded or sealingly connected thereto. The cap 38 aids in this sealing connection in effectively closing off the hub 34, that is the aperture or apertures 35. Alternatively a sealing material may be applied to close the aperture 35. The aperture and other holes 56 diameter may be sized for controlled permeability and drainage of bleeding water.

Figure 9:
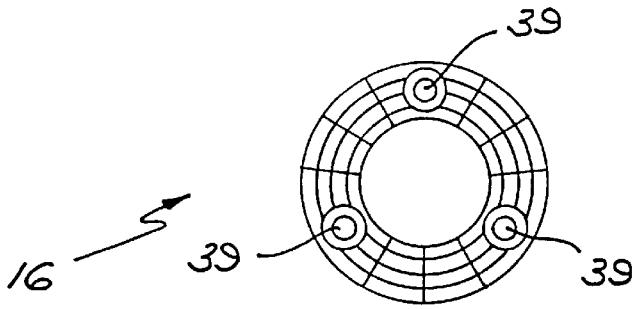
FIG. 9 is a schematic plan view of a further stress distribution member which may be employed in the formwork of FIG. 1.

In FIG. 9 there is schematically depicted an alternative construction for the stress distribution members 16. In FIG. 9, the stress distribution member 16 is of a "torroidal" configuration and is provided with three apertures 39 through which ties can pass to secure the member 16 to an opposing member on the other side of the structure 10.

Figure 10:
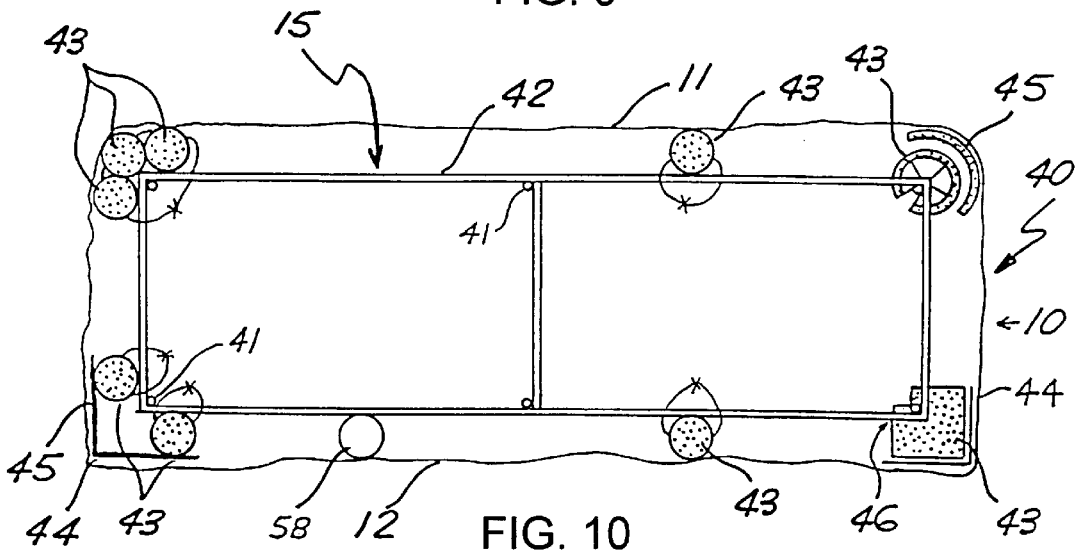
FIG. 10 is a schematic top plan view of various spacers which may be employed in the formwork of FIG. 1.

The sheets 11 and 12 may be separate sheets, or alternatively may be merely different sides of an envelope encompassing the structure 10. For example, in FIG. 10. the sheets 11 and 12 are just sides of a single envelope 40 surrounding the reinforcing assembly 15 which includes the bars 41 and transverse "stirrups" 42. To ensure that the envelope 40 is kept in desired configuration and distance from the reinforcing assembly 15, there is provided spacers 43. For example, in FIG. 10 the spacers 43 may be merely cylindrical rods or pipes arranged singularly or in groups. As one alternative, the spacers 43 could cooperate with an angled member 44. As a still further alternative, the spacers 43 could be of a "circular" configuration which snap over portions of the bar 41, stirrups 42, or when used at the corners cooperate with a corner member 45. However the main purpose of the spacers 43 is to provide concrete cover and to maintain the sheets 11 and 12 in a desired configuration. If so required the spacers 58 could be removed gradually as the concrete pour progressed.

In another example, the spacers 43 may be of a "block" configuration having channels 46 to engage the cage 15. The spacers 43 may be formed of any suitable material including plastics. As a further alternative plastics tubing can be bent and filled with concrete grout or extruded plastic profiles may be used to manufacture the spacers 43.

Figure 11:
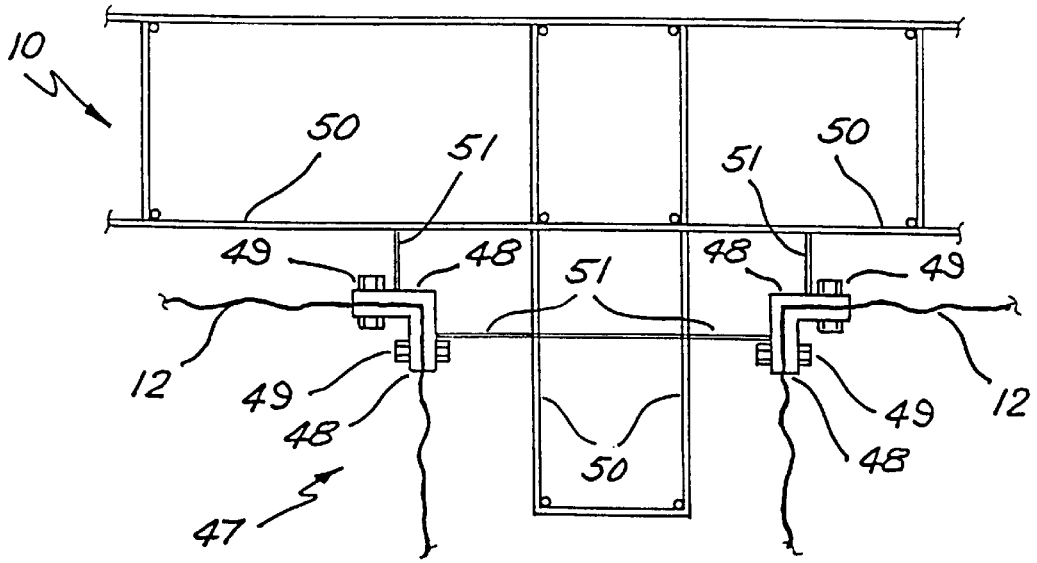
FIG. 11 is a schematic top plan view of formwork items employed to form corners, in junction with the formwork of FIG. 1.

In FIG. 11 there is schematically depicted a means of forming corners in the structure 10. In FIG. 11 the sheet 12 envelops an extension 47. To form the corners, pairs of cooperating right angle members 48 are clamped together by means of threaded fasteners 49 so as to hold the sheet 12 in the required position. The members 48 are then secured to the stirrups 50 by ties 51. The members 48 may be of plastics or metal as required. The members 48 may be glued to the sheet 12. They would also act as stress distribution members.

Figure 12:
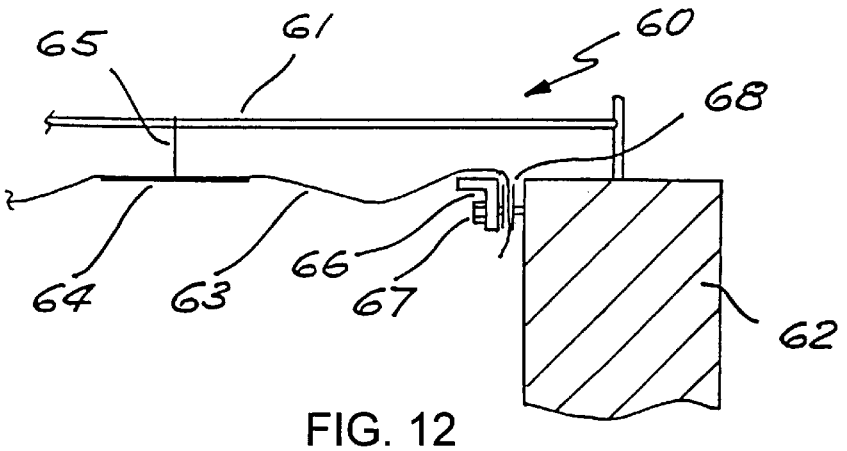
FIG. 12 is a schematic side elevation of a formwork produced in forming a ceiling of a structure.
Figure 13:
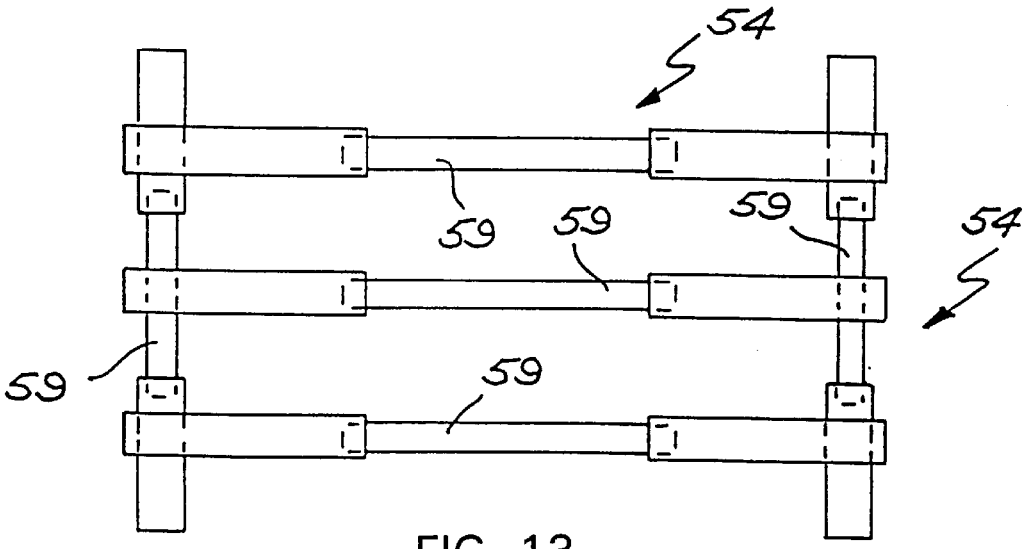
FIG. 13 is a schematic plan view of the telescopic supporting beam assembly.

In FIG. 12 there is schematically depicted a means of forming a generally horizontally extending structure 60. The structure 60 would have reinforcing members 61 and may be formed on a pre-existing wall or support 62. A sheet 63 would extend below the reinforcing 61 and would support concrete poured thereon. Suspended from the reinforcing 61 would be stress distribution members 64 held by means of ties 65. The sheet 63 would be secured to the wall 62 by means of a clamp member 66 in cooperation with a threaded fastener 67. If so required, pads or washers 68 could aid in distributing the stresses through the edges of sheet 63. As an alternative a beam assembly 54 as shown in FIG. 13 could be used to support the sheet members 64 and/or reinforcing 61. The beam assembly 54 would include telescopic sections 59 enabling the assembly 54 to adjust to different spans.

Figure 14:
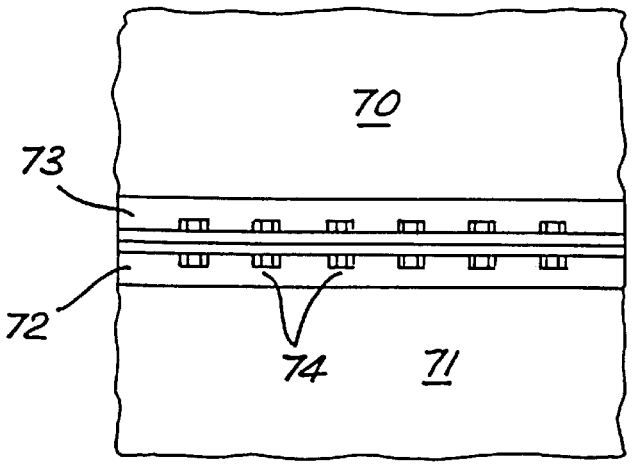
FIG. 14 is a schematic front elevation of a junction of flexible sheet material and rigid material such as metal formwork or sheet steel.
Figure 15:
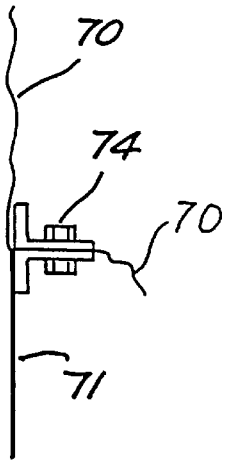
FIG. 15 is a schematic side elevation of the formwork of FIG. 14.

In FIGS. 14 and 15 there is schematically depicted a method of securing a flexible sheet 70 to other surfaces such as rigid formwork or sheet steel 71. The steel 71 would have secured to a corner thereof, a right angle bracket 72 which cooperates with a further right angle bracket 73 to securely engage the sheet 70. Threaded fasteners 74 would then pass through the brackets 72 and 73 in order to securely engage the sheet 70 and secure it to the steel 71. Again if required a reinforcing cage would be employed together with appropriate stress distribution members.

Figure 16:
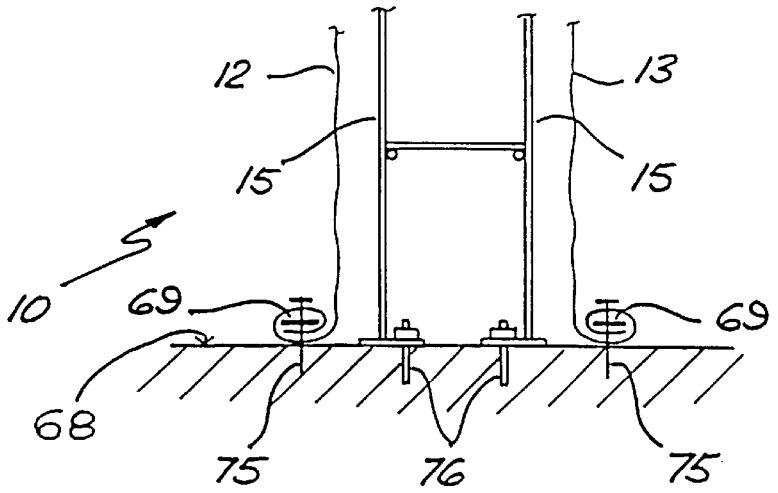
FIG. 16 schematically illustrates a connection of the formwork of FIG. 1, to a supporting surface.

In FIG. 16 there is schematically depicted the lower end of the structure 10 of FIG. 1. The structure 10 is schematically depicted as being secured to a generally horizontal surface 68. The sheets 12 and 13 are clamped to the surface 68 by means of bracket 69 about which the sheets 12 and 13 may be wrapped if so required in order to enhance the connection therebetween. The bracket 69 would then be secured to the surface 68 by means of fasteners 75. Additionally, the reinforcing cage 15 would be secured to the surface 68 by means of fastening to the starter bars 76.

Figure 18:
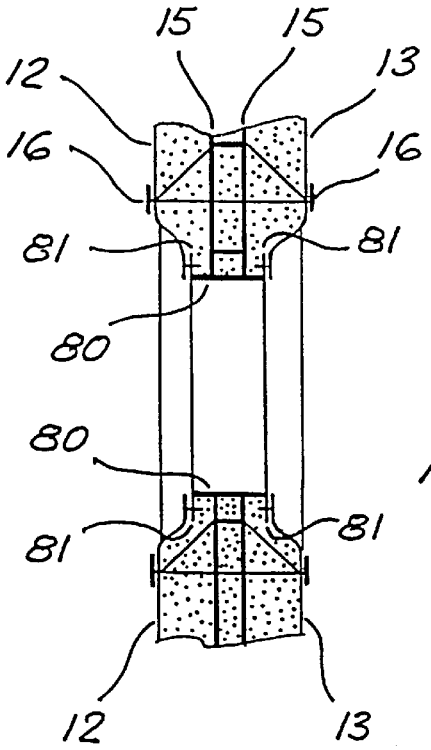
FIG. 18 is a schematic sectioned side elevation of the formwork of FIG. 17.
Figure 17:
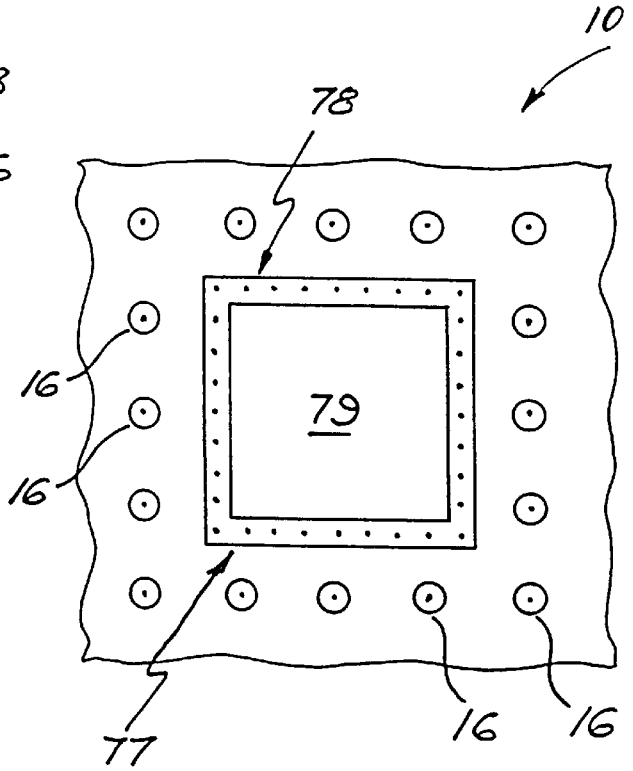
FIG. 17 is a schematic front elevation of an aperture to be formed in the formwork of FIG. 1.

In FIGS. 17 and 18 there is schematically depicted an assembly 77 to form an aperture in the structure 10. The assembly 77 includes a rectangular frame 78. However it should be appreciated that the frame 78 could be of any desired configuration. The frame 78 encompasses a space 79 which passes through the structure 10. The frame 78 of this embodiment includes four channel members 80 which surround the space 79. The channel members 80 have flanges 81 to which the sheets 12 and 13 would be secured by fasteners and brackets if required. The frame 78 can also be secured to the cage 15 if so required in order to maintain its location.

In FIG. 19 there is schematically depicted a duct member fitting 82 to form a passage through the structure 10 for the passage of pipes and/or cabling or other such surface conduits. The duct member 82 has end flanges 83 which would be bonded or otherwise secured to the sheets 12 and 13. Extending between the flanges 83 is a cylindrical portion 84 which basically encloses the passage extending through the structure 10. The duct member 82 may have a "blind" end and be used to form a recess or hole in the structure 10. Some fittings may be connected to and held by the flexible sheets with no attachment to the reinforcement.

In FIGS. 20 and 21 there is schematically depicted an arrangement for having the horizontal structure 60 of FIG.

12, extend across the wall 62. A collar 85 may be made of plastics or metal, and consisting of two segments 86 are secured together by means of threaded fasteners. In this particular embodiment, the wall 62 could be a column. Each segment 86 would have a flange 87 to which the sheet 63 could be secured by means of clamping plates, fasteners or adhesives, so as to be supported thereto.

In FIGS. 22 to 25, there is schematically depicted various different means by which one or more wall sections may be cast, with the sections being joined for sealing and/or strength purposes. For example, in FIG. 22, there is schematically depicted a wall section 88 to be cast in conjunction with a wall section 89. As previously discussed, each of the wall sections 88 and 89 would employ a flexible sheet 90 to enclose a space which receives the concrete 91. The reinforcing cage 92 would support the sheet 90. In this embodiment, the wall sections 88 and 89 have abutting ends 93 and 94. The end 93 has an end plate 95 defining a vertical groove. The plate 95 would have flanges 96 to which the sheet 90 would be secured by clamp plates and threaded fasteners.

The end 94 has an end plate 98 which has a longitudinally extending ridge which is received within the longitudinally extending recess provided by the plate 95. If so required, spacers 97 may be fitted adjacent the corners of the structures 88 and 89 in order to correctly locate the plates 95 and 98. Plates 95 and 98 may be made from rolled steel sections.

Figure 23:
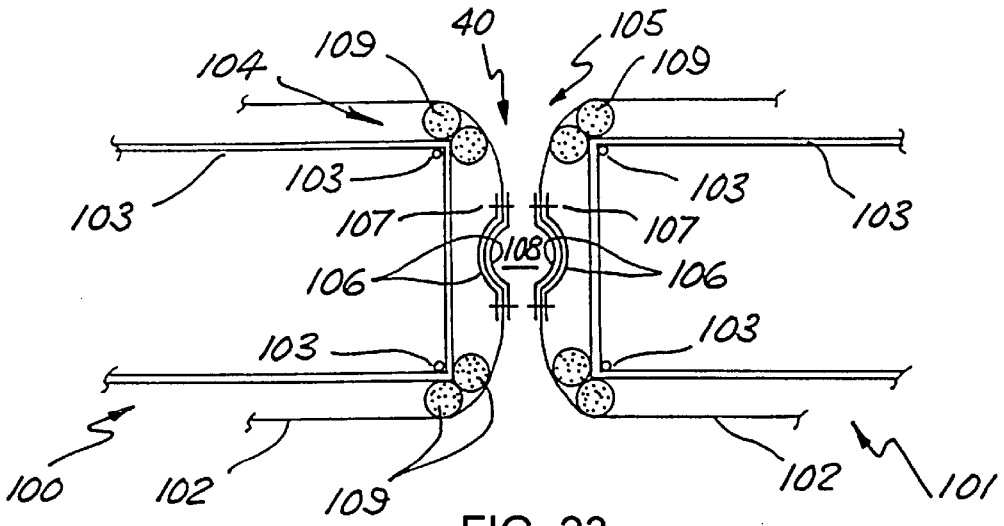
FIG. 23 is a schematic sectioned plan view of the interconnection between two wall sections employing the formwork of FIG. 1.

In FIG. 23 the wall sections 100 and 101 have sheets 102 and reinforcing cage 103 in a manner as previously discussed. Again appropriate stress distribution members and ties would be employed. However in this embodiment the ends 104 and 105 are provided with longitudinally extending trough members 106 which are arranged in pairs, with each of the pairs being clamped to the sheet 102 separately by threaded fasteners 107. The opposing pairs cooperate to provide a longitudinally extending generally cylindrical passage 108 which receives a seal member or set in composition to sealingly and/or rigidly connect the two wall sections 100 and 101 by means of a metal pipe or filled with concrete. If so required, corner spacers 109 could be employed.

Figure 24:
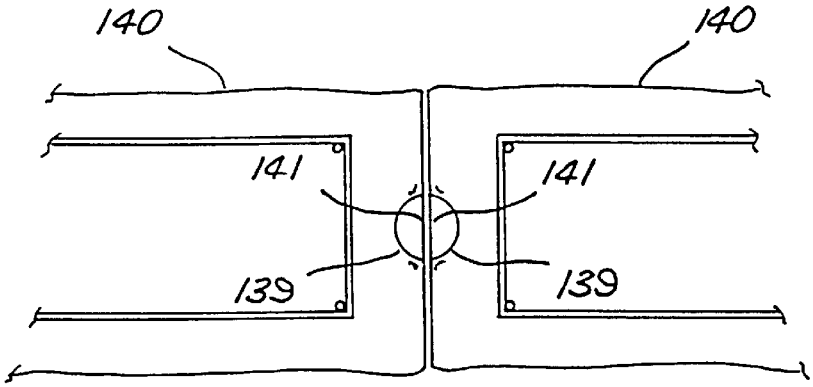
FIG. 24 is a schematic sectioned plan view of the interconnection between two wall sections employing the formwork of FIG. 1.

In FIG. 24 an alternative arrangement is shown. In this embodiment, semi-circular sections 139 preferably made of PVC are bonded to the sheets 140 by adhesives. After casting, the sheet portions 141 within the void formed, are cut, and the void filled with concrete, metal rod or pipe, or other locking means. Spacers used to retain the sheets 140 are not shown.

Figure 25:
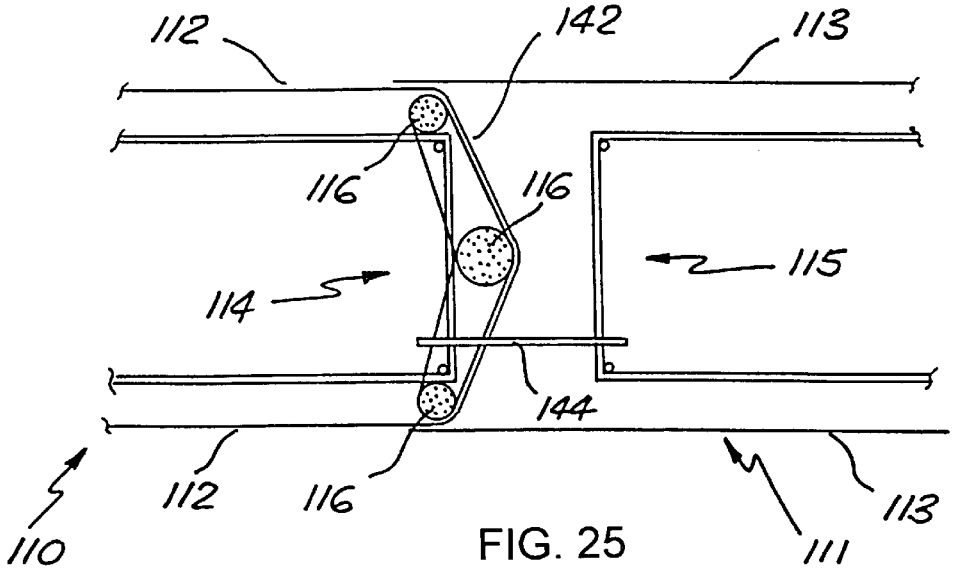
FIG. 25 is a further schematic sectioned plan view of the connection between an already formed wall and the formwork of FIG. 1.

In the embodiment of FIG. 25, the wall sections 110 and 111 are formed using separate sheets 112 and 113. The wall section 110 would be cast first and the section 111 cast so as to be attached thereto. The sheet 112 would have bonded to it the two sheets 113, with the sheet portion 142 to be removed. The section 110 would have a protruding end 114 which would project into a recessed end 115 of the section 111. Spacers 116 would aid in forming the end 114.

Reinforcing rods 144 could be bonded in the section 110 and protrude from the end 114, to be located in the section 111, to aid in joining the sections 110 and 111, when the section 111 is cast.

Figure 26:
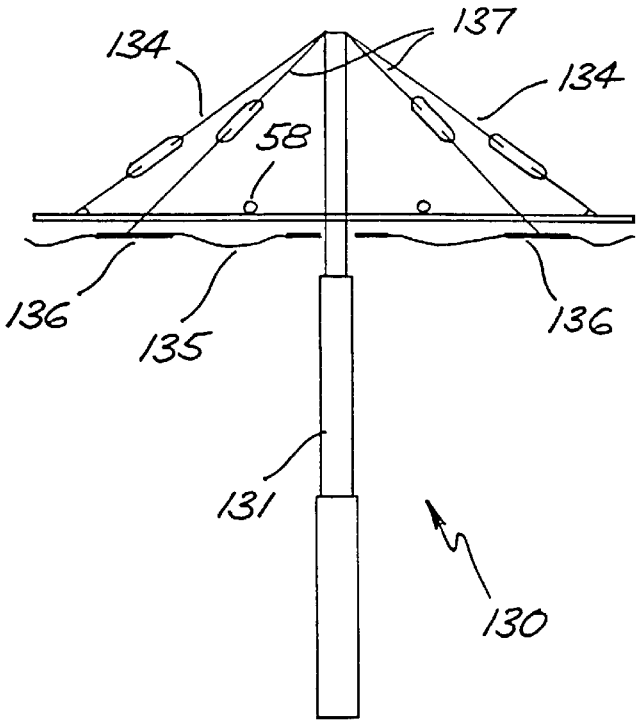
FIG. 26 is a schematic side elevation of a formwork and suspension assembly therefor.
Figure 27:
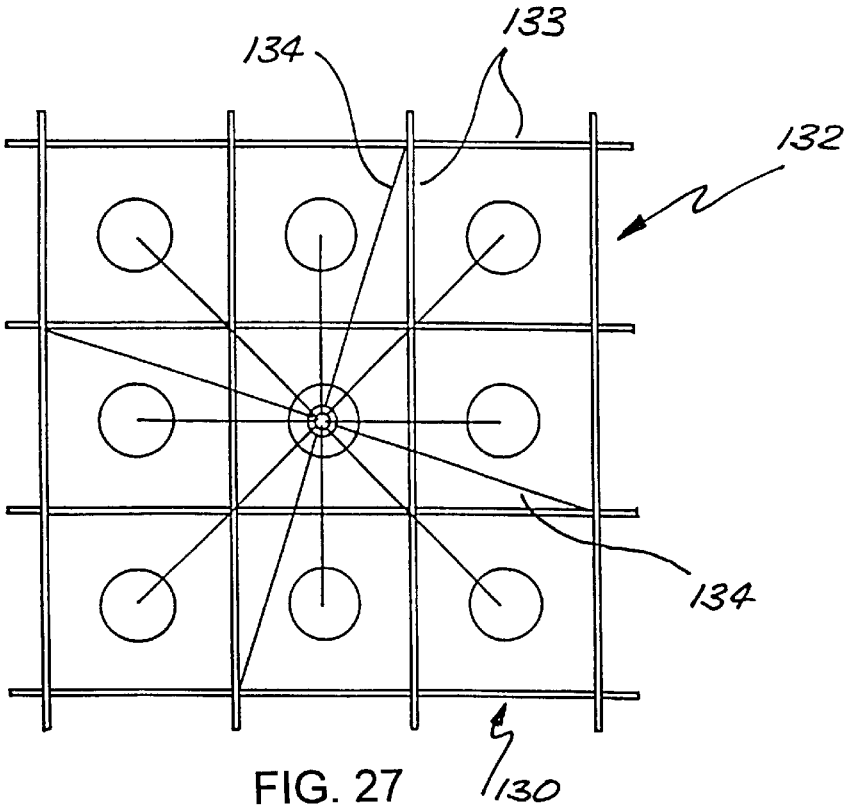
FIG. 27 is a schematic top plan view of the formwork and suspension assembly of FIG. 26.

In FIGS. 26 and 27 there is schematically depicted a formwork assembly 130. The formwork assembly 130 would include a support telescopic post 131 supporting a reinforcing grid 132 consisting of reinforcing rods 133. More particularly, the grid 132 would be supported by support lines or cables 134. A flexible sheet 135 would be supported by stress distribution members 136 again supported by flexible lines or cables 137. The cables 137 are similar to the previously discussed ties but with adjustability in length, and can be released from hooks and re-used. Concrete would then be poured on top of the sheet 135 to form a generally horizontally extending structure.

Figure 28:
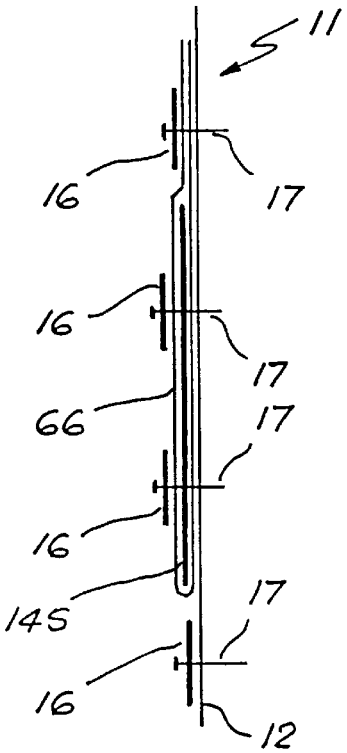
FIG. 28 is a schematic side elevation of a modification of the formwork of FIG. 1 to provide a plane concrete surface.
Figure 29:
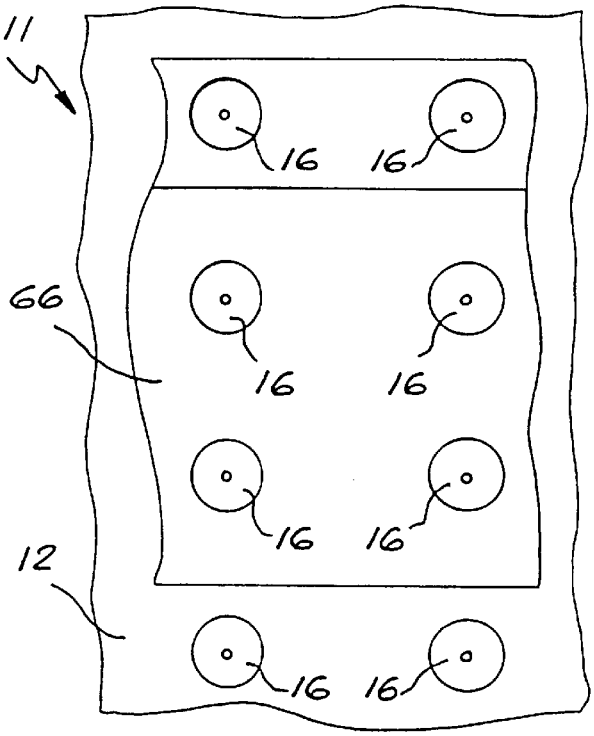
FIG. 29 is a front elevation of the modification of FIG. 28.

In FIGS. 28 and 29, there is schematically depicted a means of adapting the formwork assembly 11 deforming generally planar surfaces on the structure 10. In this embodiment, a generally rigid sheet 145 is enclosed by the sheet 66 which forms a sleeve and is placed between several of the stress distribution members 16 and the sheet 12. A sleeve may be suspended from support assembly 18 of FIG. 1, and is completely reusable.

Figure 30:
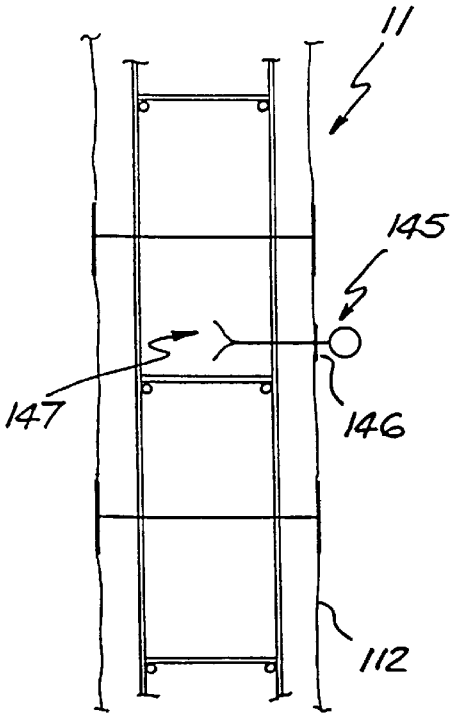
FIG. 30 is a schematic side elevation of the formwork of FIG. 1, with attachments applied thereto.

In the embodiment of FIG. 30, the formwork assembly 11 includes hooks or eyelets 145. The hooks 145 have a flange 146 which may be secured to the sheet 112. The hooks 145 include an end 147 to ensure that the hook 145 is securely anchored in the concrete structure formed. The hooks 145 may be mechanically fixed to stress distribution member 16 of FIG. 1. A plurality of the hooks 145 provide attachments for foreign objects e.g. a reinforced earth strap.

Figure 31:
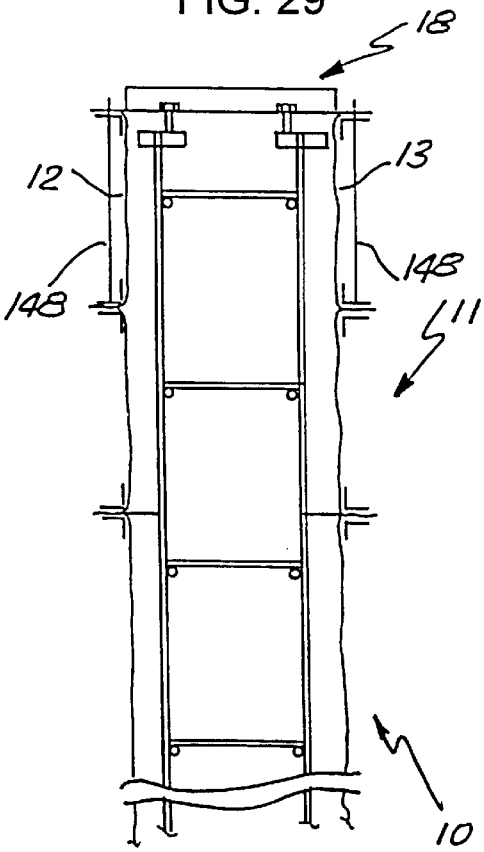
FIG. 31 is a schematic side elevation of the formwork of FIG. 1, modified to provide for adjustment of the tension in the sheet material employed in the formwork.

FIG. 31 shows the formwork assembly 11 including cables or rods 148 which extend from the support assembly 18 (as described with reference to FIG. 1). Tension in the sheets 12 and 13 can be controlled by the cables or rods 148. Support assembly 18 may be repeated along the height of structure 10.

Figure 32:
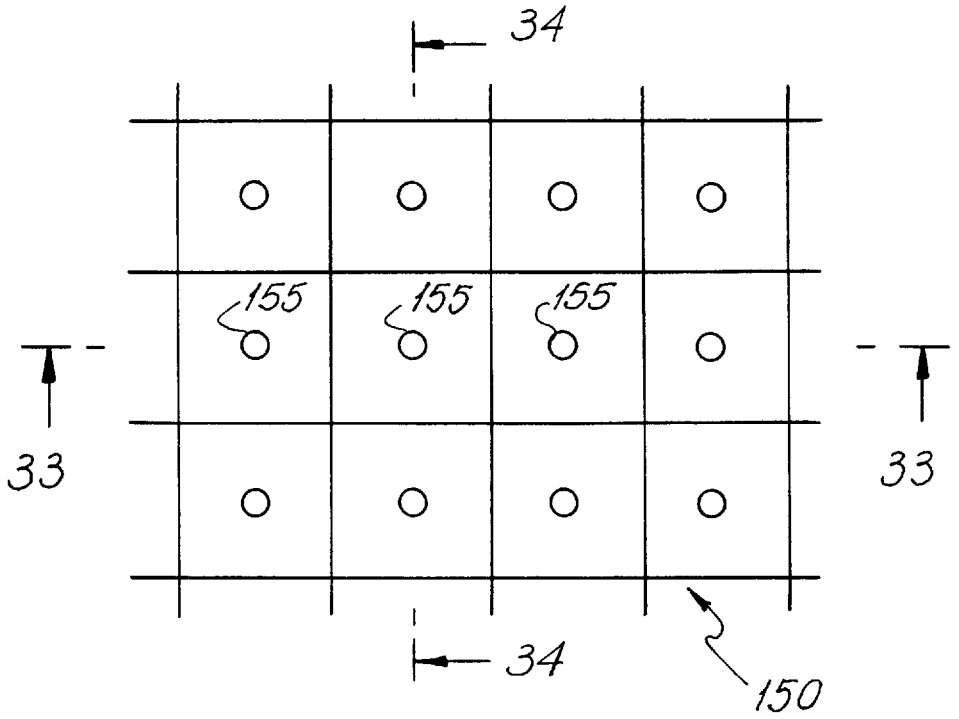
FIG. 32 is a schematic plan view of a concrete thin panel structure.
Figure 33:
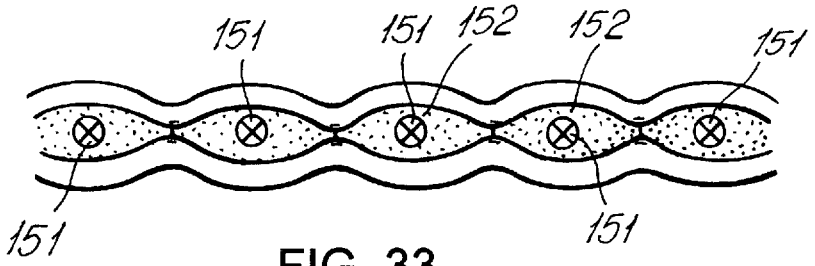
FIG. 33 is a schematic sectioned side elevation of the thin panel structure of FIG. 32, sectioned along the line A—A.
Figure 34:
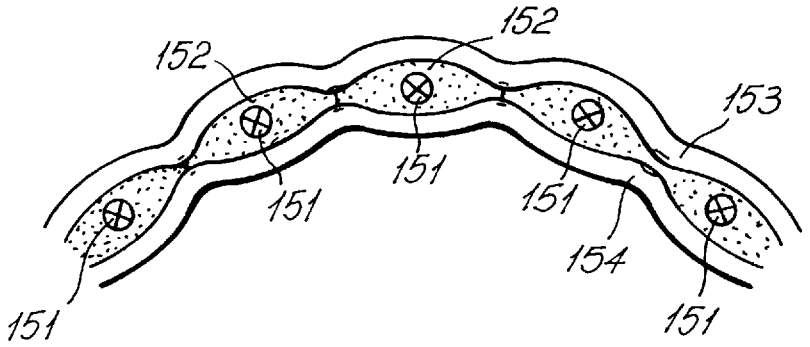
FIG. 34 is a schematic sectioned side elevation of the thin panel structure of FIG. 32, sectioned along the line B—B.

In FIGS. 32 to 34, there is schematically depicted a structure 150 which may be formed by the formwork assembly of FIG. 1. In this embodiment, a thin panel structure 150 formed is curved. The panel 150 would have reinforcing rods 151 to which there is attached spacers 152 to aid in retaining the sheets 153 and 154 in the desired position during pouring. Stress distribution members 155 and associated ties would be used.

The formwork assembly of FIG. 1 can be further optimised by reducing the volume of concrete used.

Figure 35:
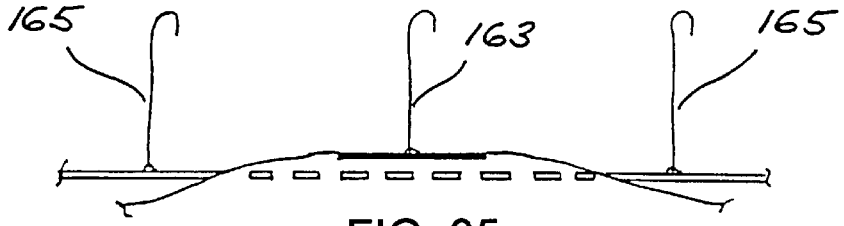
FIG. 35 is a schematic side elevation of a formwork employed to cast a ceiling, wall or other concrete structure.
Figure 36:
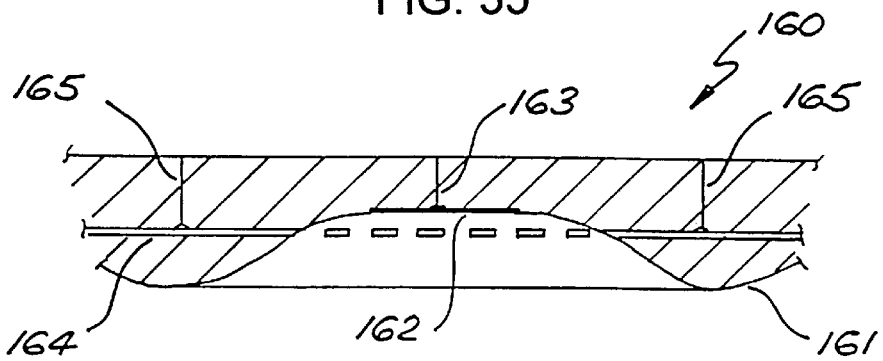
FIG. 36 is a schematic sectioned side elevation of a concrete section cast employing the formwork of FIG. 35.

In FIGS. 35 and 36, there is schematically depicted the configuration which may be used employing the formwork assembly of FIG. 1. In this embodiment, a concrete structure 160 is formed by the use of a sheet 161 and stress distribution members 162 and associated ties 163. Reinforcing members 164 would be supported by ties 165. The ties 163 and 165 would extend upwardly to a support structure. In this embodiment, the stress distribution members 163 are located in the centre of the reinforcement grid 164 and in approximately the same plane as the reinforcing grid 164. After pouring of the concrete, the sheet 161 would deflect and extend downwardly so as to provide sufficient concrete cover for the reinforcing grid 164. The depth of coverage of the concrete is determined by the length of the ties 163.

Figure 37:
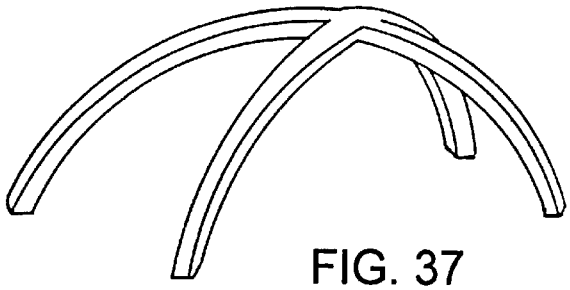
FIGS. 37, 38 and 39 schematically depict a variety of structure shapes which may be formed employing the formwork of FIG. 1.
Figure 38:
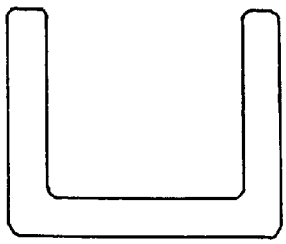
Figure 39:
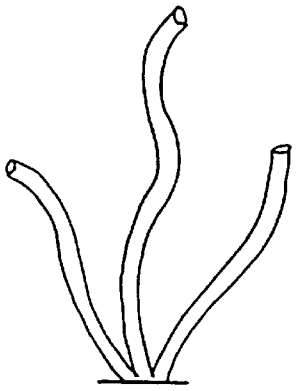

In FIGS. 37, 38 and 39 there is schematically depicted various regular and irregular structure shapes which may be cast employing the formwork assembly of FIG. 1.

Post-tensioning techniques can be applied by assembling the pre-tensioning tendons and ducts, within the formwork prior to concrete placement.

In the above described preferred embodiments, particularly those embodiments employing walls and columns, it should be appreciated that the walls and/or columns may be used in a variety of buildings and structures including sea walls, jetties and wharves.

I claim:

1. A formwork comprising:

a flexible substantially water impermeable sheet to define at least one side of a space to receive unset concrete, stress distribution members located on a major surface of the sheet at spaced locations between edges of the sheet, said major surface in use not confronting said space, said stress distribution members being rigid relative to the sheet to thereby firstly carry the pressure of concrete applied to the stress distribution members area and secondly carry the sheet forces generated by concrete pressure applied to the surrounding sheet, and thirdly by their size redistributing and limiting the sheet distresses, arising from the concrete within the space pressing on the sheet, to thereby aid the sheet to withstand pressure applied to the sheet; and a plurality of ties, each tie being fixed to and extending from an associated one of the stress distribution members, the ties extending through the sheet and being fixed so as to support the associated stress distribution members in a desired position to thereby support the sheet in a desired configuration until the concrete sets.

2. The formwork of claim 1, wherein the sheet substantially encloses the space, and stress distribution members are located on opposite sides of the space with the ties extending therebetween.

3. The formwork of claim 1 or 2, further including reinforcing members providing a frame within the space to carry at their top the forces generated by the said formwork arising from delivering unset concrete pressure within the space when the sheet is suspended from the frame.

4. The formwork of claim 3, wherein said formwork includes a support frame for said flexible sheet, and means of movably supporting said support frame on said reinforcing members for vertical relative movement thereto.

5. The formwork of claim 4, wherein said support frame is adjustably connected to said reinforcing members.

6. The formwork of claim 1, further including pads located between the stress distribution members and the sheet and being fixed to the associated sheet.

7. The formwork of claim 1, wherein said stress distribution members and/or ties are adapted to be withdrawn after setting of the concrete.

8. The formwork of claim 1, wherein the stress distribution members are of a disc or ring configuration and the ties are flexible.

9. The formwork of claim 1 or 2 wherein said stress distribution members are sized and shaped to fully utilise flexible strength, taking into consideration concrete pressure, sheet area directly supported by the stress distribution member, sheet strength, allowable deflection of the concrete surface, and tie spacing, so as to provide an external pattern having portions with a double curvature.

10. The formwork of claim 3, wherein said reinforcing members are arranged in a predetermined configuration said predetermined configuration determining the configuration of a structure to be moulded in the formwork.

11. The formwork of claim 1, wherein said stress distribution members permit the flow of water therethrough to permit the draining of water from concrete supported by the formwork.

12. A method of erecting formwork to at least partly enclose a space to receive unset concrete, said method comprising the steps of:

providing a flexible sheet;

locating on a major surface of the sheet, a plurality of stress distribution members prior to or after suspending the sheet from a fixed location, said stress distribution members being rigid relative to the sheet to thereby firstly carry the pressure of concrete applied to the stress distribution members and secondly carry the sheet forces generated by concrete pressure applied to the surrounding sheet, and thirdly by their size redistributing and limiting the sheet distresses to thereby aid the sheet to withstand pressure applied to the sheet, the stress distribution members being positioned at spaced locations between edge portions of the sheet;

providing a plurality of ties;

suspending the sheet from a fixed location;

securing each tie to an associated stress distribution member and fixing the ties so that the stress distribution members are held in a desired position to thereby hold the sheets in a desired configuration defining at least one side of said space, with the tie members extending from their associated stress distribution members and through the sheet and into said space.

13. A method of forming a concrete structure comprising the method of claim 12, wherein said sheet substantially encloses said space and stress distribution members are located on opposite sides of said space with the ties extending therebetween.

14. A method of forming a concrete structure comprising the method of claim 12 or 13, further indicating the step of locating said reinforcing members in said space and securing a top edge of the sheet to a top portion of said reinforcing members to aid in supporting the flexible sheet, and then delivering the concrete to said space.

15. The method of forming a concrete structure according to claim 14, further including providing a support frame for said sheet, and supporting said frame on said reinforcing members.

16. The method of forming a concrete structure according to claim 15, further including the step of adjustably supporting said frame on said reinforcing members.

17. The method of claim 12, further including locating a pad between each distribution member and the sheet, said pad being fixed to the sheet.

18. The method of claim 12, further including providing generally rigid sheet material to abut a portion of said sheet in order to provide a concrete structure cast in said formwork with a generally planar portion.

19. The method of claim 12, wherein said sheet and/or stress distribution members are provided with apertures to drain water from said space.

20. The method of claim 12, wherein said formwork is erected adjacent to an existing wall section previously cast using said formwork system, with said sheet being joined to a sheet employed in said method and further providing reinforcement continuity between the two wall sections.

21. The method of claim 12, further including the step of providing a support structure for said sheet, with said stress distribution members being connected to said support structure, and wherein said support structure includes at least one telescopic member which is adjustable in length.

22. The method of claim 12, further including step of providing attachment means to enable items to be attached to a concrete structure cast in the formwork, said attachment means passing through said sheet so as to have a portion located in said space and so as to project out from said sheet.

23. A method of forming a concrete structure, said method including the step of providing formwork according to the method of claim 13, delivering concrete to said space and permitting the concrete to set.

24. The method of claim 23, wherein said concrete structure includes a pair of abutting concrete structures having confronting surfaces defining a void to receive a connecting member therein.

25. The method of claim 12, further including the step of providing a structure of reinforcing members, said structure supporting said flexible sheet.

26. The method of claim 25, wherein said sheet substantially encloses said reinforcing structure but is spaced therefrom.

* * * * *

UNITED STATES PATENT AND TRADEMARK OFFICE

CERTIFICATE OF CORRECTION

PATENT NO. : 5,857,293

DATED : January 12, 1999

INVENTOR(S) : Assadollah Redjvani

It is certified that error appears in the above-identified patent and that said Letters Patent is hereby corrected as shown below:

On title page, item 22, "Nov. 4" should be – – Nov. 2– – .

Signed and Sealed this

Thirty-first Day of August, 1999

*Attest:*

Q. TODD DICKINSON

*Attesting Officer*

*Acting Commissioner of Patents and Trademarks*